US005867928A

United States Patent [19]

Plebani

[11] Patent Number: 5,867,928

[45] Date of Patent: Feb. 9, 1999

[54] SEMI-AUTOMATIC GAS-OPERATED SHOTGUN WITH AN IMPROVED SAFETY DEVICE

[75] Inventor: Dario Plebani, Ome, Italy

[73] Assignee: Franchi S.p.A., Italy

[21] Appl. No.: 953,827

[22] Filed: Oct. 19, 1997

[30] Foreign Application Priority Data

Feb. 24, 1997 [IT] Italy ..... MI97A0390

[51] Int. Cl.[6] ..... F41A 3/00

[52] U.S. Cl. ..... 42/17; 42/21; 42/70.01

[58] Field of Search ..... 42/17, 21, 70.01

[56] References Cited

U.S. PATENT DOCUMENTS

| | | | |
|---|---|---|---|
| 1,648,831 | 11/1927 | Strickler | 42/17 |
| 2,224,928 | 12/1940 | Reising | 42/3 |
| 2,794,285 | 6/1957 | Clarkson | 42/17 |
| 3,171,225 | 3/1965 | Green et al. | 42/17 |
| 4,601,122 | 7/1986 | Beretta | 42/21 |
| 4,856,217 | 8/1989 | Benelli | 42/17 |

*Primary Examiner*—Charles T. Jordan
*Assistant Examiner*—Meena Chelliah
*Attorney, Agent, or Firm*—Sofer & Haroun LLP.

[57] ABSTRACT

A semi-automatic gas-operated shotgun includes a safety device which locks the firing mechanisms of the gun and simultaneously locks the breech-block slide in the open position, spaced from the cartridge chamber of the gun, by the operation of a single safety button.

1 Claim, 3 Drawing Sheets

SEMI-AUTOMATIC GAS-OPERATED SHOTGUN WITH AN IMPROVED SAFETY DEVICE

BACKGROUND OF THE INVENTION

The present invention relates to a semi-automatic gas-operated shotgun.

It is known that a shotgun of the type in question comprises a receiver for housing and supporting the firing mechanisms of the gun, a breech block guided for movement from a position in which a respective cartridge chamber is closed to a position in which the cartridge chamber is open, and a lifting device for transporting cartridges from a cartridge magazine to the cartridge chamber, the lifting device being constituted essentially by a lever articulated to opposed walls of the receiver and having a longer, substantially elongate-spoon-shaped portion extending towards the cartridge magazine and a shorter portion known as a lug extending towards the interior of the receiver.

As for all firearms of the aforesaid type, it is known for the shotgun considered herein to have a safety device or, more simply: a safety catch, generally constituted by a button-like element extending through the receiver, supported for sliding by the opposed walls thereof, and accessible from outside the walls in order to be moved manually from an engaged position in which it interferes positively with the firing mechanisms, preventing their operation, to a released position in which the firing mechanisms can be operated freely.

In particular, the present invention relates to a safety device having improved structural and functional characteristics for a semi-automatic shotgun.

With reference to shotguns of the aforesaid type, it is known that there is a need to be able to gain access to the cartridge chamber in order to change the cartridge loaded therein for another of a different type.

For this purpose, it is necessary to move the breech-block slide and then to restrain it in the open position in which it is normally restrained only when all of the cartridges have been fired.

At the moment, in order to change the cartridge, the user has to retract the breech block with one hand, and to hold the breech block in the open position with the other hand with which he is supporting the gun, and the cartridge, which is expelled automatically from the cartridge chamber by the action of the ejector, may fly out. Still holding the breech block in the open position manually, the user then has to insert the new cartridge and finally close the cartridge chamber by releasing the breech block.

It is clear and is recognized that, although this procedure has the advantage of quick cartridge-changing, which is much appreciated during shooting, on the other hand it still requires experience and a high degree of manual dexterity and, in spite of all this, still involves a high risk.

The technical problem which the present invention proposes to solve is to overcome this disadvantage.

SUMMARY OF THE INVENTION

This problem is solved according to the invention by a semi-automatic gas-operated shotgun comprising a safety device having the characteristics set out in the following claims.

BRIEF DESCRIPTION OF THE DRAWINGS

The characteristics and advantages of the invention will become clearer from the following description of an embodiment of a safety device according to the invention, given with reference to the appended drawings, provided purely by way of non-limiting example, in which.

DETAILED DESCRIPTION OF THE PREFERRED EMBODIMENT

Figure 1:
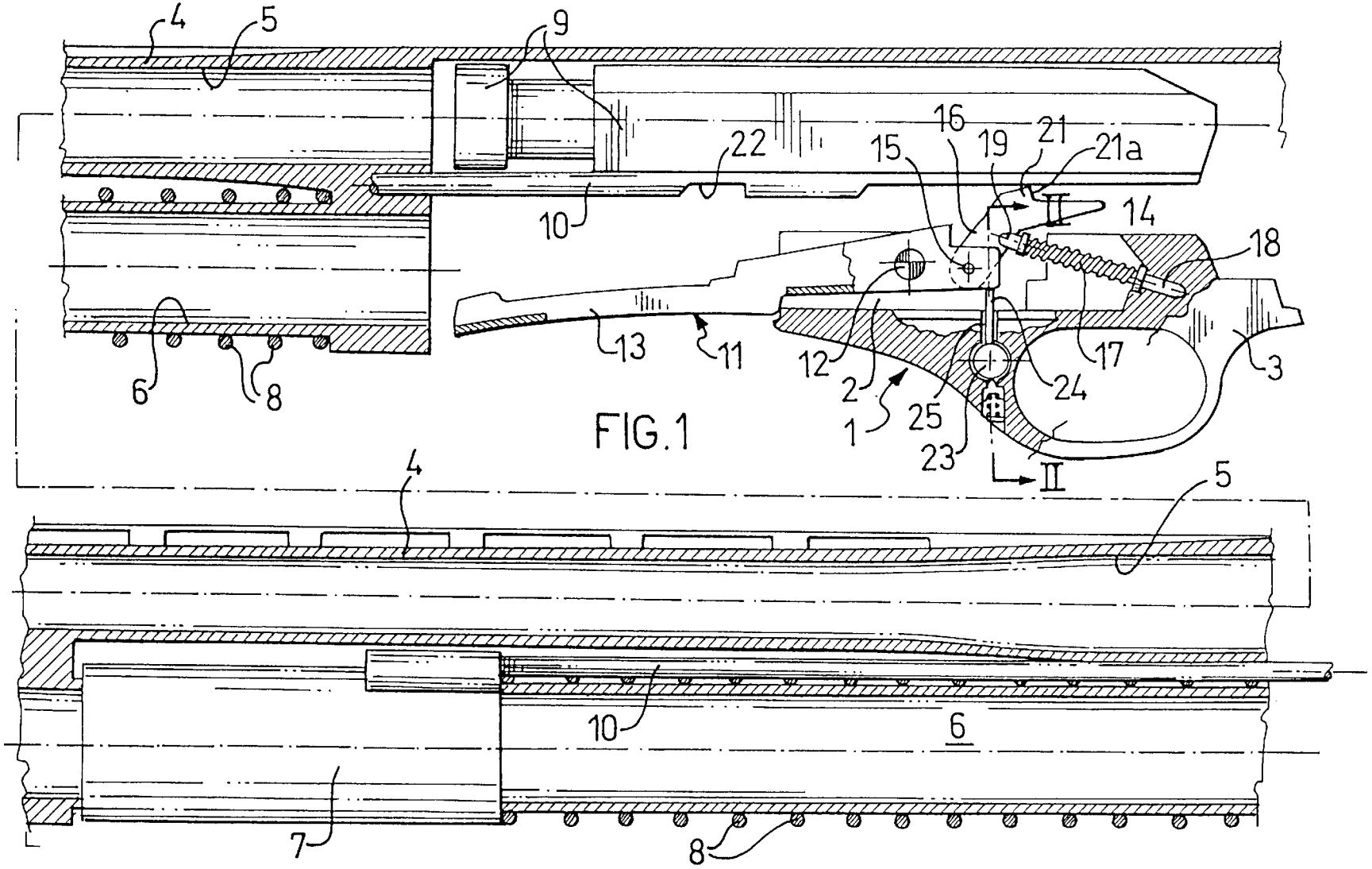
FIG. 1 shows schematically a detail of a semi-automatic shotgun incorporating a safety device according to the invention, in one operative stage.
Figure 3:
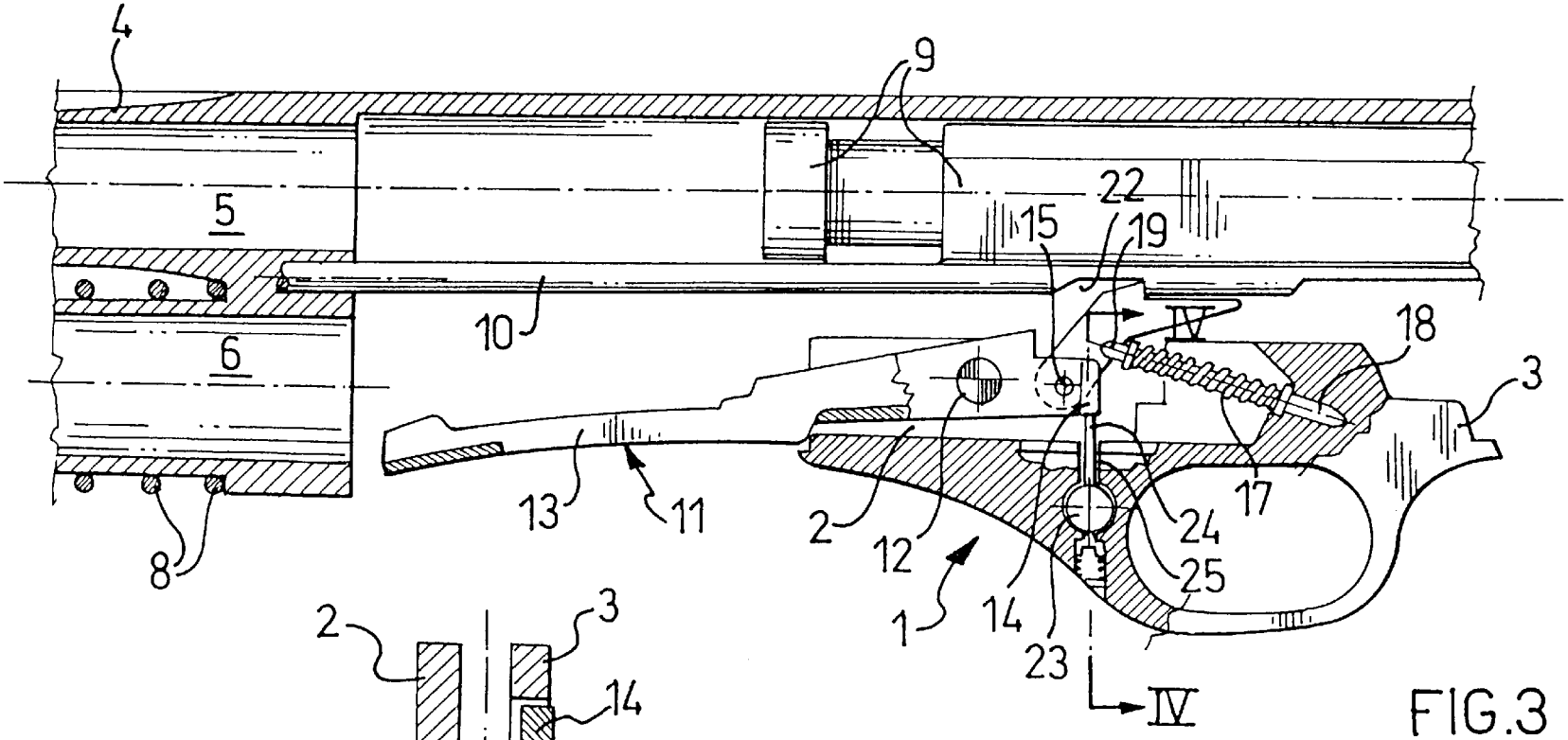
FIG. 3 shows schematically the same detail as FIG. 1, in a second operative stage.
Figure 2:
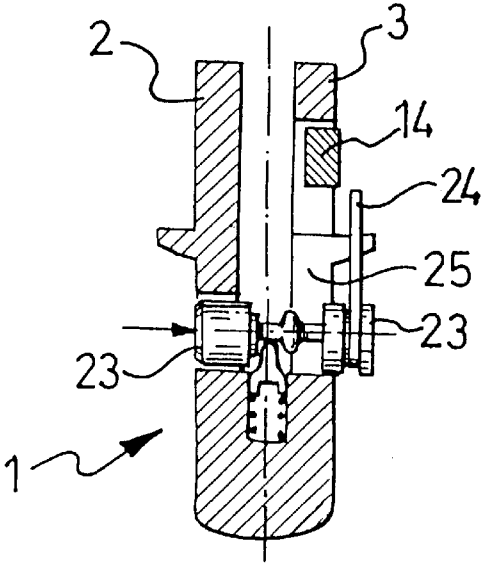
FIG. 2 is a section taken on the line II—II of FIG. 1, on an enlarged scale.
Figures 4, 5, 6:
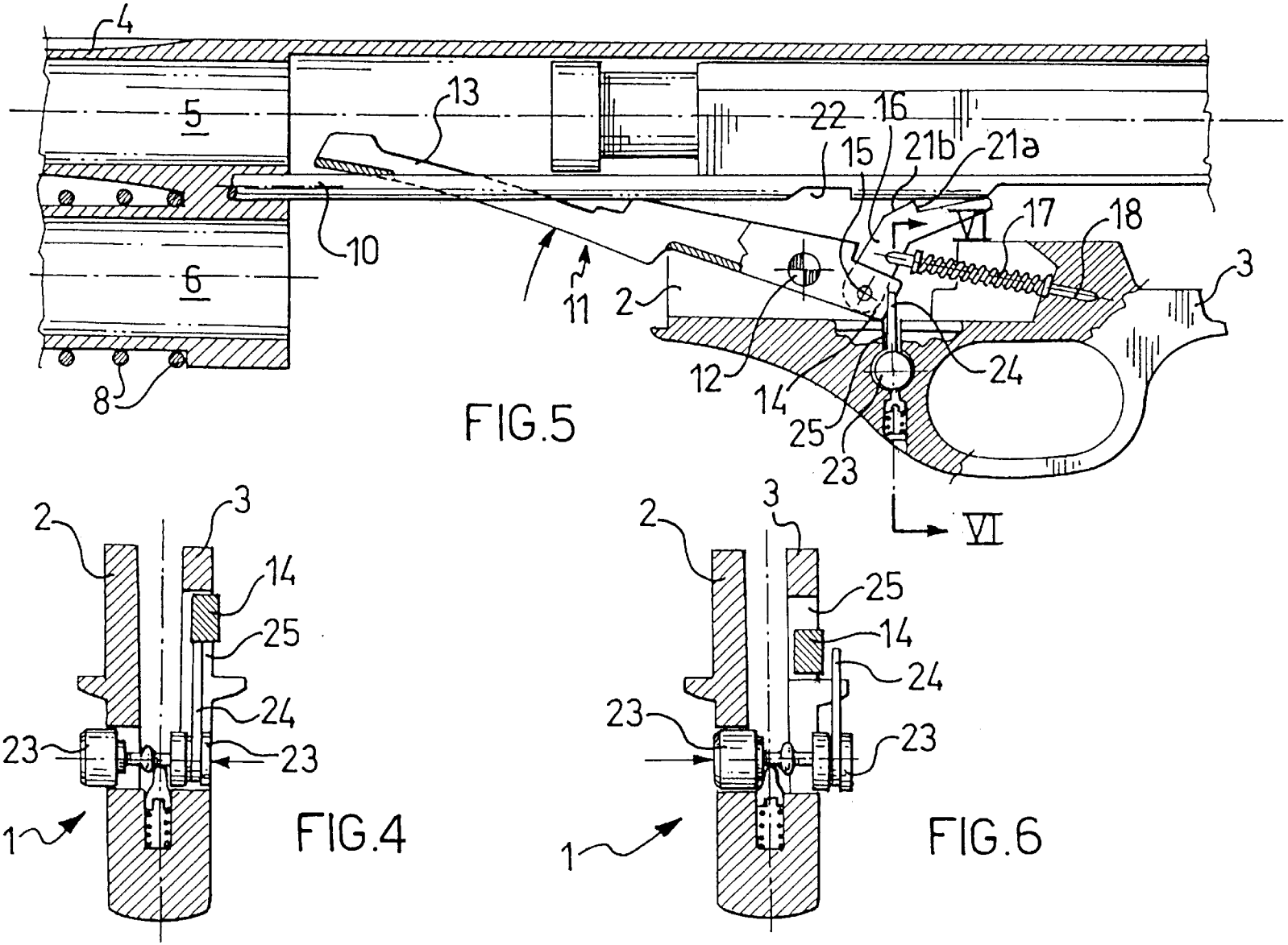
FIG. 4 is a section taken on the line IV—IV of FIG. 3, on an enlarged scale.
FIG. 5 shows schematically the same detail as FIG. 1, in a third operative stage.
FIG. 6 is a section taken on the line VI—VI of FIG. 5, on an enlarged scale.

With reference to the drawings, a semi-automatic gas-operated shotgun, of the type considered above, comprises:

a receiver 1 having opposed walls 2, 3 between which the firing mechanisms of the gun, which are not shown because they are known and wholly conventional, are housed and supported, a barrel 4 in the breech end of which a cartridge chamber 5 is formed, a cartridge magazine 6 parallel to the barrel 4 and extending beneath it, a piston 7 mounted slidably on the cartridge magazine 6 by which it is guided for movement in opposition to a spring 8, a breech-block slide 9 operated by arming rods 10 fixed to the piston 7 at one end and to the breech-block slide 9 at the other end; the breech-block slide 9 is guided for movement from a position in which the cartridge chamber 5 is closed (FIG. 1) to a position in which it is open (FIG. 3), a lifting device 11 for transporting cartridges from the cartridge magazine 6 to the cartridge chamber 5; this lifting device 11, which is also known as a transporter, is constituted, essentially, by a lever articulated at 12 to the opposed walls 2, 3 of the receiver 1 and having an elongate, substantially spoon-shaped portion 13 extending from the articulation point 12 towards the cartridge chamber 5, and a shorter portion 14 known as the lug of the lifting device extending from the articulation point 12 towards the interior of the receiver 1. The lifting device 11 is movable angularly about the articulation point 12 from a lowered position for collecting a cartridge from the magazine 6 (FIG. 1) to a raised position (FIG. 5) in which it has brought a cartridge substantially into alignment with the cartridge chamber 5 in which it is to be inserted automatically by the breech-block slide.

A lever 16 is articulated to the lug 14 of the lifting device 11 with an articulation axis 15 parallel to that of the lifting device. This lever 16 is subject to the action of a spring 17, the spring-guide rod 18 of which has a rounded head 19 engaged in a hemispherical recess in the rear of the lever 16. On the front of the lever 16 there is a tooth 21 which has a leading edge 21*a* facing towards the breech and a trailing edge 21*b* inclined towards the muzzle of the gun. The tooth 21 (otherwise known as the pin of the lifting device) is intended to engage a respective notch 22 formed in an arming rod 10 of the breech-block slide 4.

A safety button 23 extending transversely through the receiver 1 is supported for sliding by the opposed walls 2, 3 thereof in a position below the articulation axis 12 of the lifting device 11 and spaced therefrom. The safety button 23 is accessible from outside the walls 2, 3 in order to be moved from an engaged position (FIGS. 1 and 3) in which it interferes with the firing mechanisms in known manner, preventing their operation, to a released position in which the firing mechanisms can be operated freely.

A rigid, rod-shaped element 24 is fixed to the safety button 23 close to an end thereof and projecting sideways from the button.

The position of this rod-shaped element 24 on the button 23 and its length are such that it is guided for moving through a slit or slot 25 formed in the wall 3 of the receiver 1 from a first position (safety button engaged) in which it is beneath and in contact with the lug 14 of the lifting device 11 (when the spoon-shaped portion 13 thereof is in the "lowered" position) to a second position (safety button released), in which it is moved away from its position beneath the lug 14.

The functions of the safety device 23–24 of the present invention will now be described.

In an initial condition (FIG. 1), the shotgun is ready to fire.

In this condition, the breech-block slide 9 is in a position such as to close the cartridge chamber 5 in which a first cartridge (not shown) is loaded; the lifting device 11 is in the position in which its spoon-shaped portion 13 is "lowered", ready to collect a second cartridge from the cartridge magazine 6; the safety button 23 is in the released position, and its rod-shaped element 24 is moved away from the lug 14 of the lifting device 11.

It should be noted that, in this initial condition, the safety button 23 can be moved from the engaged position to the released position and vice versa at will, correspondingly positioning the rod-like element 24 beneath and away from the lug 14 of the lifting device 11.

The initial condition having been considered, it is assumed that the cartridge which is in the chamber 5 is to be changed for another of a different type.

For this purpose (FIGS. 3 and 4), the safety button 23 and its rod-shaped element 24 are first moved to the engaged position in order to lock the firing mechanisms and simultaneously to lock the lifting device 11 in the position described above (the rod-shaped element 24 is positioned beneath the lug 14 of the lifting device).

The breech-block slide 9 is then retracted manually, overcoming the resistance of the spring 8, to the open position in which it is then restrained by the tooth or pin 21 acted on by its spring 17 which has snap-engaged it in the notch 22 of the arming rod 10.

Since the rod-shaped element 24 of the safety button 23 prevents the lifting device 11 from moving angularly about the articulation axis 12, the breech-block slide 9 remains positively locked on the lifting device.

During the retraction of the breech-block slide 9, the first, loaded cartridge is extracted from the cartridge chamber 5 and automatically expelled therefrom.

At this point, after the desired cartridge of a different type has been arranged manually in the cartridge chamber 5, the safety button 23 is moved to the released position, the rod-shaped element 24 simultaneously being moved away from its position beneath the lug 14. The lifting device 11 is now free to move angularly about its articulation axis 12 which movement is provided for by the spring 8 which returns the breech block 9 to the position in which the cartridge chamber 5 is closed.

The shotgun is ready to fire again or for "double safety" to be set: that is, safety with regard to the firing mechanisms and with regard to the lifting device 11.

It is clear from the foregoing description that the safety device 23–24 of the invention for a semi-automatic shotgun enables two different and important functions to be performed simultaneously by a single operation on a single "button": that is, locking of the firing mechanisms of the gun and positive restraint of the breech-block slide in the open position, thus affording easy and safe access to the cartridge chamber and hence permitting easy changing of the cartridge present therein for another of a different type.

Another important advantage is that it is not possible to hold the slide open without the firing mechanisms being locked, that is, without the safety device being engaged.

A further advantage is that the device 23–24 of the invention is simple and inexpensive to produce and to fit.

What is claimed is:

1. A semi-automatic gas-operated shotgun, including a receiver for housing and supporting the firing mechanisms of the gun, a breech-block slide movable from a position in which a cartridge chamber is closed to a position in which the chamber is open, a lifting device articulated to the receiver and movable angularly from a lowered, cartridge-collecting position to a raised position for supplying the cartridge to the chamber, means associated with the lifting device for locking the breech-block slide open when the lifting device is in the lowered position, a safety button supported for moving through the receiver from an engaged position for locking the firing mechanisms to a released position, the semi-automatic gas-operated shotgun comprising a rigid rod-shaped element fixed to the safety button, projecting sideways therefrom and fixed for translation therewith, the rod-shaped element being positioned like a wedge beneath the lifting device in the lowered position, locking it in this position when the safety button is moved to the engaged position.

* * * * *